US010452024B2

(12) United States Patent
Nakamura et al.

(10) Patent No.: US 10,452,024 B2
(45) Date of Patent: Oct. 22, 2019

(54) REPLACEABLE UNIT AND IMAGE FORMING APPARATUS

(71) Applicant: SHARP KABUSHIKI KAISHA, Sakai, Osaka (JP)

(72) Inventors: Ginga Nakamura, Sakai (JP); Shohtaroh Okamoto, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/215,286

(22) Filed: Dec. 10, 2018

(65) Prior Publication Data

US 2019/0179261 A1 Jun. 13, 2019

(30) Foreign Application Priority Data

Dec. 12, 2017 (JP) ..... 2017-238019

(51) Int. Cl.
*G03G 21/18* (2006.01)
*G03G 15/00* (2006.01)

(52) U.S. Cl.
CPC ..... *G03G 21/1835* (2013.01); *G03G 15/50* (2013.01)

(58) Field of Classification Search
CPC ..... G03G 21/1835; G03G 15/50; G03G 2221/1892; G03G 21/1875; G03G 21/168
See application file for complete search history.

(56) References Cited

U.S. PATENT DOCUMENTS

2011/0243578 A1* 10/2011 Ukai ..... G03G 21/1896 399/12
2015/0005134 A1* 1/2015 Shimizu ..... F16H 13/04 476/67
2015/0277281 A1* 10/2015 Mushika ..... G03G 15/0865 399/12
2015/0277283 A1* 10/2015 Taguchi ..... G03G 15/0865 399/12

FOREIGN PATENT DOCUMENTS

JP 2010-039437 A 2/2010

* cited by examiner

*Primary Examiner* — Sandra Brase
(74) *Attorney, Agent, or Firm* — ScienBiziP, P.C.

(57) ABSTRACT

A secondary transfer portion includes a transfer roller, a fixing member, a movable member, and a detector. The transfer roller is configured to rotate about an axis thereof when the secondary transfer portion is attached to an apparatus body. The fixing member is fixed to the axial end portion of the transfer roller. The movable member is caught on the fixing member. The detector is configured to indicate different detection states depending on a position of the movable member. The fixing member and the movable member are connected to each other through a guide mechanism (a guide groove and a guide protrusion) that is configured to move the movable member in an axial direction of the transfer roller. The movable member is moved to a detection position of the detector by rotation of the transfer roller.

7 Claims, 9 Drawing Sheets

REPLACEABLE UNIT AND IMAGE FORMING APPARATUS

BACKGROUND

1. Field

The present disclosure relates to a replaceable unit detachably attachable to an apparatus and an image forming apparatus including the replaceable unit.

2. Description of the Related Art

A recent electrophotographic image forming apparatus is generally constituted of multiple units. Some of the units are replaceable. For example, when a transfer device unit is replaced with a new one, it is desirable to adjust (initialize) image formation condition to have high image quality. Under such a circumstance, Japanese Unexamined Patent Application Publication No. 2010-39437, for example, proposes a replaceable unit that enables determination on whether the replaceable unit is new and an image forming apparatus including the replaceable unit.

The image forming apparatus descried in Japanese Unexamined Patent Application Publication No. 2010-39437 includes a movable member including a rack gear that enables the movable member to be moved linearly by rotation of a transfer roller driving gear and a limit switch including a corrugated mover that moves toward or away from a stator depending on the position of the movable member. The movable member is unmovable when not attached to the apparatus body and is made movable by a movement inhibition cancelling member when attached to the apparatus body. The movable member in a movable state is moved in a predetermined direction by rotation of the transfer roller, and thus the movement of the movable member is recognized by using the limit switch.

However, since the above-described image forming apparatus uses a rack and pinion mechanism including the transfer roller driving gear to move the movable member, the movable member is disposed outwardly of the gear, increasing the size of the detection mechanism. In other words, the movable member is configured to move linearly in a direction perpendicular to the axis of the transfer roller upon receiving the rotational force of the rotating transfer roller driving gear at the rack gear. This configuration demands that a space outwardly of the gear is large enough for linear movement of the movable member, increasing the size of the detection mechanism.

Furthermore, the image forming apparatus further includes a guide for linear movement of the movable member, increasing the complexity of the structure.

It is desirable to provide a smaller replaceable unit having a simple detection mechanism and an image forming apparatus including the replaceable unit.

SUMMARY

According to an aspect of the disclosure, there is provided a replaceable unit detachably attachable to an apparatus body. The replaceable unit includes a rotating body, a fixing member, a movable member, and a detector. The rotating body is configured to rotate about an axis thereof when the replaceable unit is attached to the apparatus body. The fixing member is fixed to an axial end portion of the rotating body. The movable member is caught on the fixing member. The detector is configured to indicate different detection states depending on a position of the movable member. The fixing member and the movable member are connected to each other through a guide mechanism configured to move the movable member in an axial direction of the rotating body. The movable member is moved to a detection position of the detector by rotation of the rotating body.

According to another aspect of the disclosure, there is provided an image forming apparatus including the replaceable unit according to the aspect of the disclosure and a controller configured to determine whether the replaceable unit is a new one based on a detection result of the detector. The controller is configured to initialize an operation condition of the replaceable unit when the replaceable unit is determined as a new one.

DESCRIPTION OF THE EMBODIMENTS

First Embodiment

Hereinafter, an image forming apparatus according to a first embodiment is described with reference to the drawings.

Figure 1:
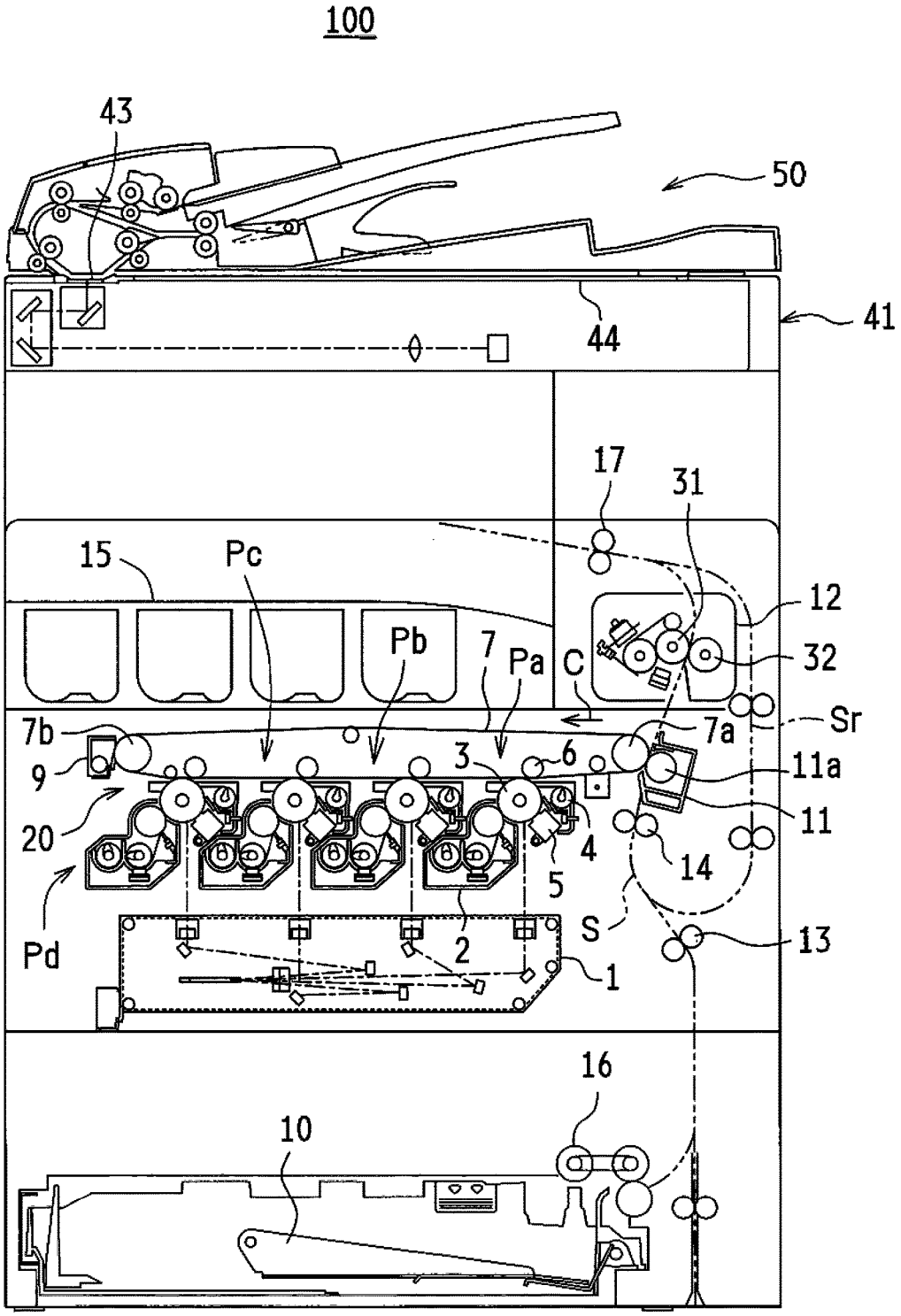
FIG. 1 is a schematic side view illustrating an image forming apparatus according to a first embodiment.

FIG. 1 is a schematic side view illustrating the image forming apparatus according to the first embodiment.

The image forming apparatus 100 (one example of an apparatus body) is a multi-function printer having functionalities of a scanner, a photocopier, a printer, and a facsimile.

The image forming apparatus 100 is configured to send an image of a document read by an image scanner to an external device (corresponding to the functionality of a scanner) or form a color or monochrome image of a document read by the image scanner or of image data sent from the external device on a sheet (corresponding to the functionality of a copier, a printer, and a facsimile).

An automatic document feeder 50 (ADF) is disposed above an image scanner 41 and supported in an openable manner relative to the image scanner 41. When the automatic document feeder 50 is open, a platen 44 as an upper portion of the image scanner 41 is uncovered, allowing a document to be manually placed on the platen 44. The automatic document feeder 50 is configured to automatically send the document thereon to a position above a document pass-through portion 43 of the image scanner 41. The image scanner 41 scans the placed document or the document sent from the automatic document feeder 50 to produce image data.

The image forming apparatus 100 includes an optical scanner 1, development devices 2, photosensitive drums 3 (one example of a photoreceptor), a drum cleaner 4, a charger 5, an intermediate transfer belt 7, a fixer 12, a sheet path S, a paper feed cassette 10, and a tray 15, for example.

The image forming apparatus 100 handles image data of a color image containing black (K), cyan (C), magenta (M) and yellow (Y) color components and image data of a monochrome image containing a single-color component (for example, black). The image forming apparatus 100 includes an image transferring portion 20 including four developing devices 2, four photosensitive drums 3, four drum cleaners 4, and four charges 5, which constitute four image stations Pa, Pb, Pc, and Pd respectively corresponding to black, cyan, magenta, yellow toner images, to form four kinds of toner images.

The drum cleaner 4 is configured to remove and collect the toner remaining on the photosensitive drum 3. The charger 5 is configured to uniformly electrically charge the surface of the photosensitive drum 3 at a predetermined potential. The optical scanner 1 is configured to apply light to the photosensitive drum 3 to form an electrostatic latent image. The developing device 2 is configured to develop the electrostatic latent image on the photosensitive drum 3 to form a toner image on the photosensitive drum 3. These steps are performed on each of the photosensitive drums 3 to form toner images in different colors on the photosensitive drums 3.

Intermediate transfer rollers 6 are disposed above the photosensitive drums 3 with the intermediate transfer belt 7 therebetween. The intermediate transfer belt 7 is supported by a driving roller 7*a* and a driven roller 7*b* in a tensioned state and circulated in a direction indicated by an arrow C. The toner remaining on the intermediate transfer belt 7 is removed and collected by a belt cleaner 9. The toner images in different colors on the photosensitive drums 3 are successively transferred one on top of another onto the intermediate transfer belt 7 to form a color toner image.

The intermediate transfer belt 7 forms a nipping region with a transfer roller 11*a* of a secondary transfer portion 11 (one example of a replaceable unit) where the sheet delivered through the sheet path S is delivered by the transfer roller 11*a* while being nipped between the intermediate transfer belt 7 and the transfer roller 11*a*. The toner image on the intermediate transfer belt 7 is transferred onto the sheet passing through the nipping region and the sheet is delivered to the fixer 12. The transfer roller 11*a* of the secondary transfer portion 11 is described in detail later with reference to FIG. 2 and FIG. 3.

The fixer 12 includes a fixing roller 31 and a pressure roller 32 configured to rotate with a sheet therebetween. The fixer 12 sandwiches the sheet, which has the transferred toner image thereon, between the fixing roller 31 and the pressure roller 32 and heats and applies pressure to the sheet. Thus, the toner image is fixed on the sheet.

The paper feed cassette 10, which stores sheets for image formation, is disposed below the optical scanner 1. The sheet in the paper feed cassette 10 is picked up by a sheet pick-up roller 16 and delivered through the sheet path S. The sheet passes through the secondary transfer portion 11 and the fixer 12, and then the sheet is discharged onto the tray 15 by a discharge roller 17. In the sheet path S, a sheet registration roller 14, a delivery roller 13 that encourages delivery of the sheet, and the discharge roller 17 are disposed. The sheet registration roller 14 is configured to temporarily stop the sheet to align the front end of the sheet and then start delivering the sheet such that arrival of the sheet at the nipping region coincides with the transferring timing of the toner image in the nipping region, which is located between the intermediate transfer belt 7 and the transfer roller 11*a*.

The image forming apparatus 100 in FIG. 1 includes only one paper feed cassette 10. However, the image forming apparatus 100 may include two or more paper feed cassettes 10 that store different kinds of sheets.

The sheet may be printed not only on the front surface but also on the front and rear surfaces. In such a case, the sheet at the discharge roller 17 is delivered in a reverse direction to a sheet inversion path Sr to invert the sheet. The sheet is delivered to the sheet registration roller 14 again and an image is formed on the rear surface in the same way as the image formation on the front surface. Then, the sheet is discharged onto the tray 15.

The image forming apparatus 100 includes an openable side wall, for example. When the side wall is open, the sheet path S and the secondary transfer portion 11 are exposed to the outside. This allows removal of a jammed sheet and replacement of the secondary transfer portion 11.

The secondary transfer portion 11 has a limit (lifetime) and starts deteriorating when the operating time or the number of transferring operations on sheets has reached a predetermined value, for example. Thus, the secondary transfer portion 11 is replaceable. When the secondary transfer portion 11 is replaced with a new one, image formation condition is adjusted (initialized) to obtain high image quality. The image forming apparatus 100 according to the embodiment includes a detecting mechanism that determines whether the secondary transfer portion 11 is a new one or a used one.

Next, the secondary transfer portion 11 is described in detail with reference to the drawings.

Figure 2:
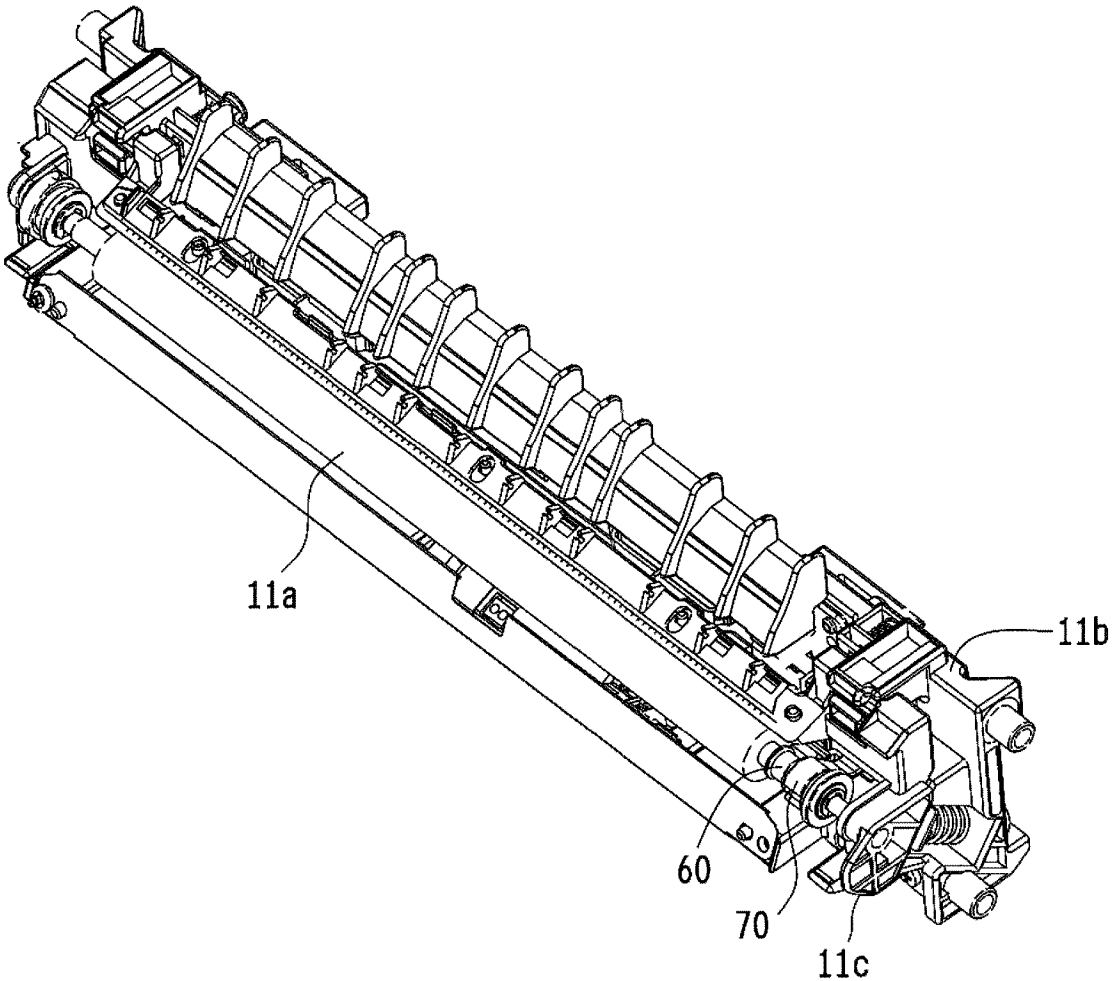
FIG. 2 is a perspective view illustrating a secondary transfer portion according to the first embodiment.
Figure 3:
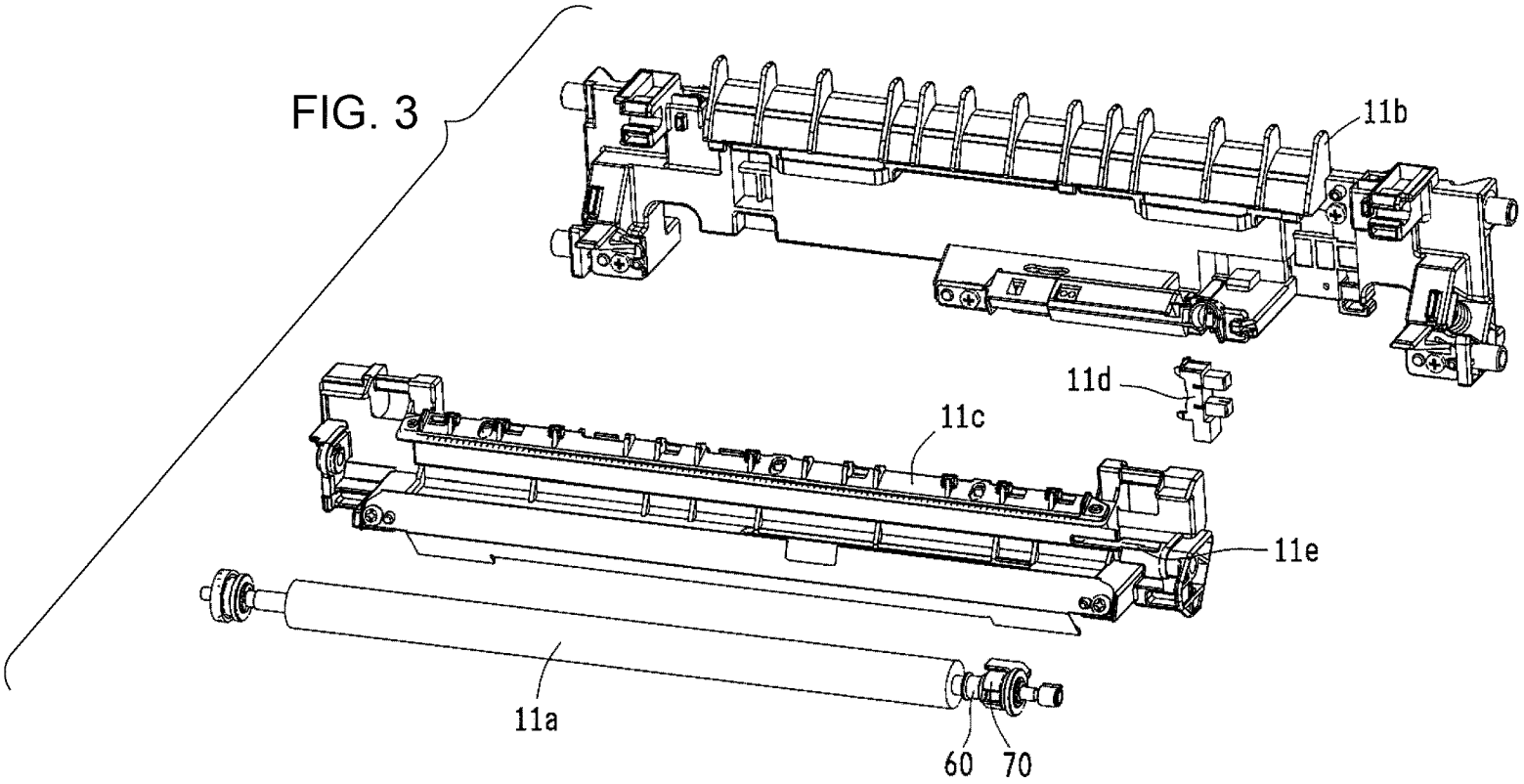
FIG. 3 is an exploded view of the secondary transfer portion in FIG. 2.

FIG. 2 is a perspective view illustrating the secondary transfer portion according to the first embodiment. FIG. 3 is an exploded view of the secondary transfer portion in FIG. 2.

The secondary transfer portion 11 includes a transfer roller 11*a* (one example of a rotating boy), a holder retainer 11*b*, a roller holder 11*c*, and a detector 11*d*.

A fixing member 60 is fixed to an axial end portion of the transfer roller 11*a* and a movable member 70 is caught on the fixing member 60. The axial end structure including the fixing member 60 and the movable member 70 is described later in detail with reference to FIG. 5.

The holder retainer 11*b* is fixed in the image forming apparatus 100 and has an engagement portion engaged with the roller holder 11*c*.

The roller holder 11*c* is detachably attached to the holder retainer 11*b* and is retained by the holder retainer 11*b* through the engagement portion, for example. the transfer roller 11*a* is rotatably supported by the roller holder 11*c*. The transfer roller 11*a* is rotated by external force transmitted through a gear, for example. The roller holder 11*c* has a slit 11*e* in a surface facing the holder retainer 11*b*. A portion of the movable member 70 (a detection object 71, which is described later) is inserted in the slit 11*e* when the transfer roller 11*a* is attached to the roller holder 11*c*.

The detector 11*d* is attached to the holder retainer 11*b* and is an optical sensor.

Figure 4:
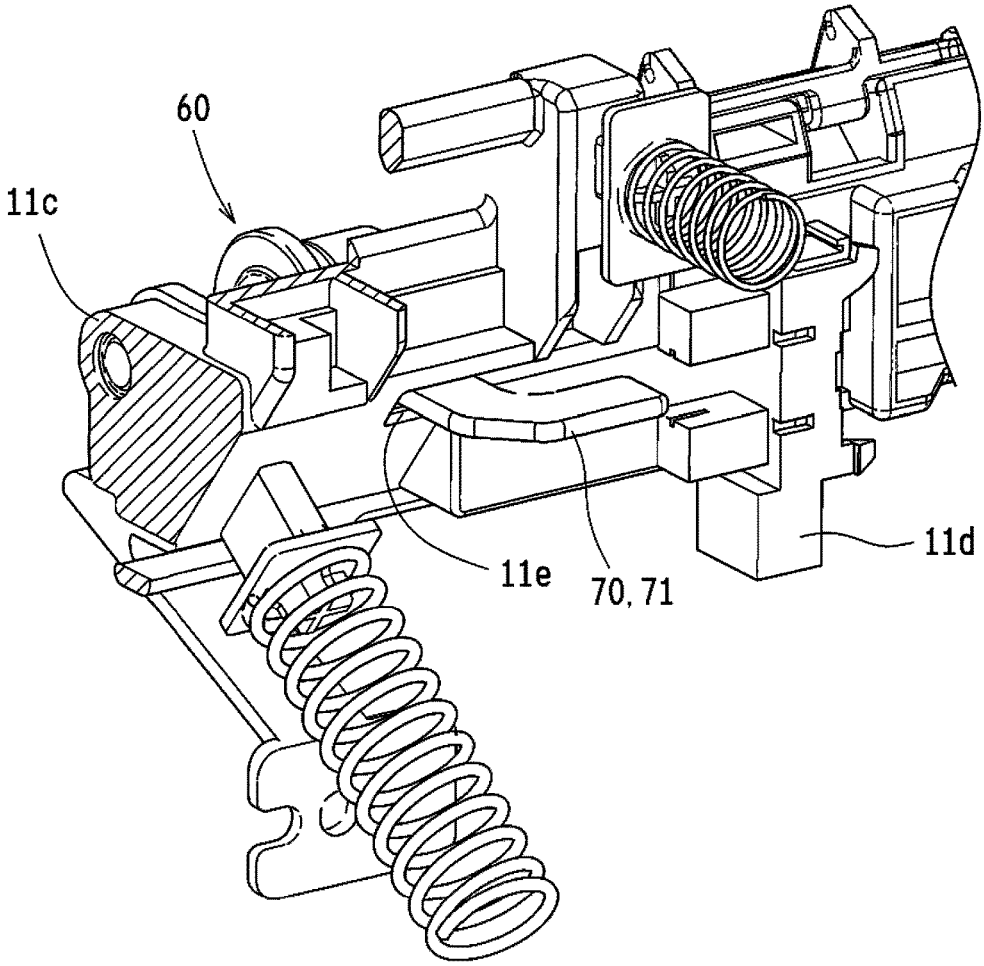
FIG. 4 is a perspective view illustrating a slit in a roller holder and the surrounding area.

FIG. 4 is a perspective view illustrating the slit in the roller holder and the surrounding area.

FIG. 4 illustrates the roller holder 11*c* in FIG. 2 from the side of the holder retainer 11*b*. Only some portions of the holder retainer 11*b* are illustrated in FIG. 4 for ease of understanding. The detector 11*d* is disposed near the slit 11*e* and the detection object 71. The detection object 71 protrudes toward the holder retainer 11*b* through the slit 11*e*. The detector 11*d* indicates different detection states depending on whether the protruded detection object 71 is detected.

Figure 5:
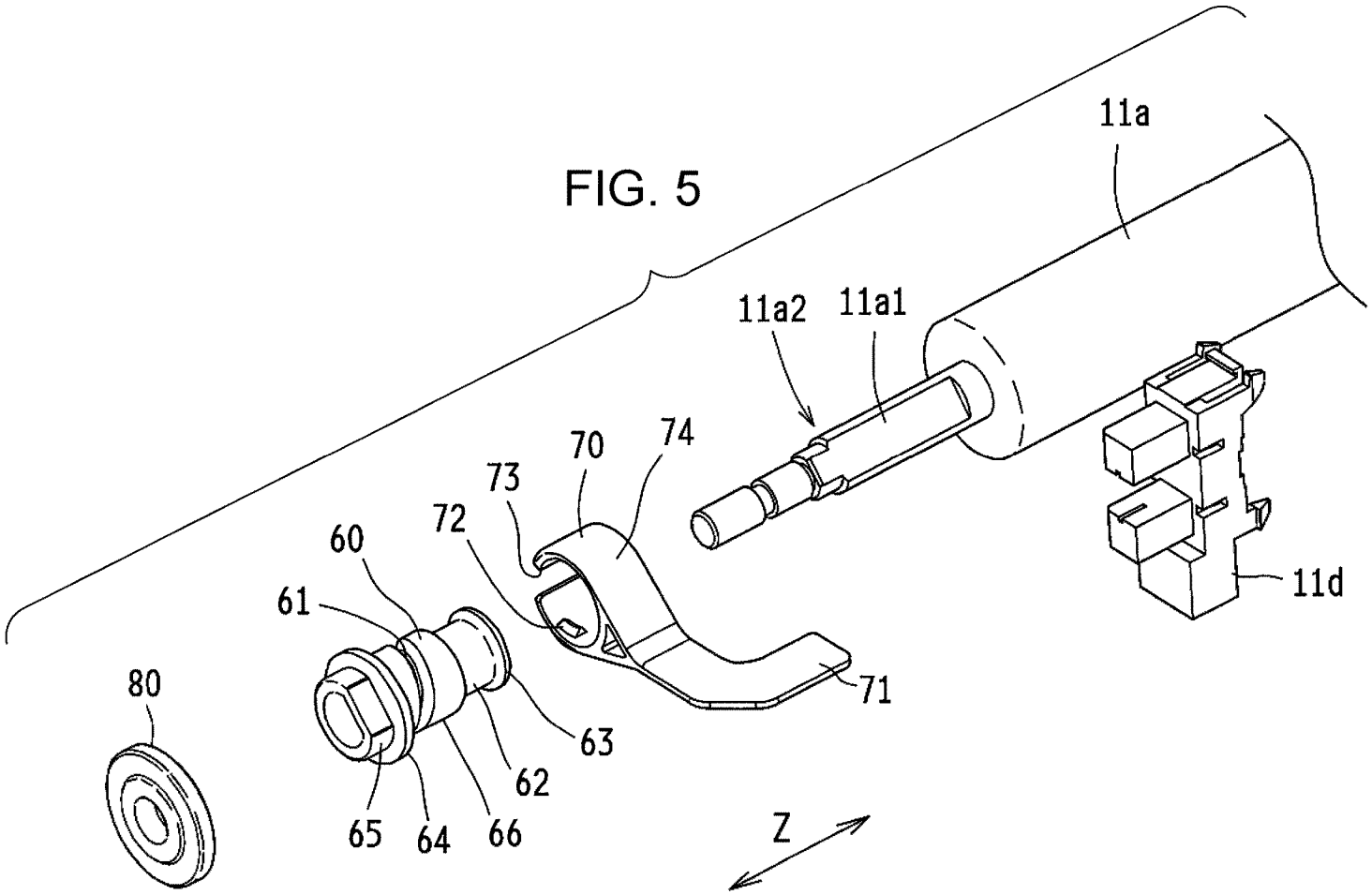
FIG. 5 is an exploded view illustrating components near an axial end of a transfer roller.

FIG. 5 is an exploded view illustrating the components near the axial end portion of the transfer roller.

FIG. 5 illustrates the fixing member 60, the movable member 70, a collar 80, which are attached to the axial end portion of the transfer roller 11*a*, and the detector 11*d*, which is disposed near the transfer roller 11*a*. The transfer roller 11*a* includes a support 11*a*2 having a smaller diameter at the end portion. The support 11*a*2 has a substantially cylindrical shape and has a D-cut surface 11*a*1 having a planar circumferential surface. In the following description, a direction along the axis of the transfer roller 11*a* may be referred to as an axial direction Z.

The fixing member 60 has a substantially cylindrical shape having sections with different diameters. The inner surface of the fixing member 60 has a shape corresponding to the surface of the support 11*a*2 and has a planar surface corresponding to the D-cut surface 11*a*1. The fixing member 60 fitted to the support 11*a*2 is caught on the D-cut surface 11*a*1, and thus the fixing member 60 rotates with the transfer roller 11*a*.

The fixing member 60 has a collar receiving portion 65, a collar stopper 64, a fix base 66, a retaining portion 62, and a wide end 63 in this order from the side away from the transfer roller 11*a*.

The collar 80 is fitted to the collar receiving portion 65. The collar stopper 64 has a larger diameter than the color receiving portion 65 and the fix base 66. The collar stopper 64 does not allow the collar 80 fitted to the collar receiving portion 65 to be pushed further beyond the collar stopper 64.

The fix base 66 has a larger outer diameter than the retaining portion 62 and has a guide groove 61 in the outer surface. The guide groove 61 extends helically about the axis of the transfer roller 11*a* from the end of the collar stopper 64 to the end of the retaining portion 62. The depth of the guide groove 61 is set such that the bottom of the guide groove 61 is substantially flush with the outer surface of the retaining portion 62. The fix base 66 is continuous with the retaining portion 62 at the smaller-diameter portion having the guide groove 61.

The retaining portion 62 has a flat outer surface. The wide end 63 has a larger diameter than the retaining portion 62. The outer diameter of the wide end 63 is smaller than the inner diameter of the movable member 70.

The collar 80 has a ring-like shape and has an inner diameter substantially equal to the outer diameter of the collar receiving portion 65. As illustrated in FIG. 2, when the transfer roller 11*a* is attached to the roller holder 11*c*, the outer surface of the collar 80 is in contact with the roller holder 11*c*. This regulates the position of the transfer roller 11*a* relative to the roller holder 11*c*. In this configuration, a moderate space is provided between the transfer roller 11*a* and the roller holder 11*c*, allowing the transfer roller 11*a* to smoothly rotate.

The movable member 70 has a base 74 having a substantially cylindrical shape and a detection object 71 extending from the base 74. The base 74 includes a guide protrusion 72 protruding from the inner circumferential surface and a slit 73 in the circumferential surface. In other words, the base 74 having the slit 73 has a ring-like shape with a gap like a Landolt ring. The detection object 71 has a plate-like shape and protrudes from the outer surface of the base 74.

The base 74 has an inner diameter larger than the outer diameter of the wide end 63 except for the portion having the guide protrusion 72. The base 74 has an inner diameter smaller than the outer diameter of the wide end 63 at the portion having the guide protrusion 72. In this configuration, when the movable member 70 is fitted to the fixing member 60, the guide protrusion 72 is caught on the wide end 63. At this time, the slit 73 in the movable member 70 allows the inner diameter of the movable member 70 to increase, allowing the guide protrusion 72 to move beyond the wide end 63. The assembling is easy.

The movable member 70 and the fixing member 60 are both formed of resin, such as polycarbonate and polyacetal (POM), for example. The movable member 70 and the fixing member 60 may be formed of different materials in view of friction resistance and processability, for example.

Next, the components in FIG. 5 in an assembled state and the movable member 70 that has been moved are described with reference to the drawings. FIG. 6A to FIG. 7C are schematic views illustrating only some components of the image forming apparatus 100 for ease of understanding.

Figure 6A:
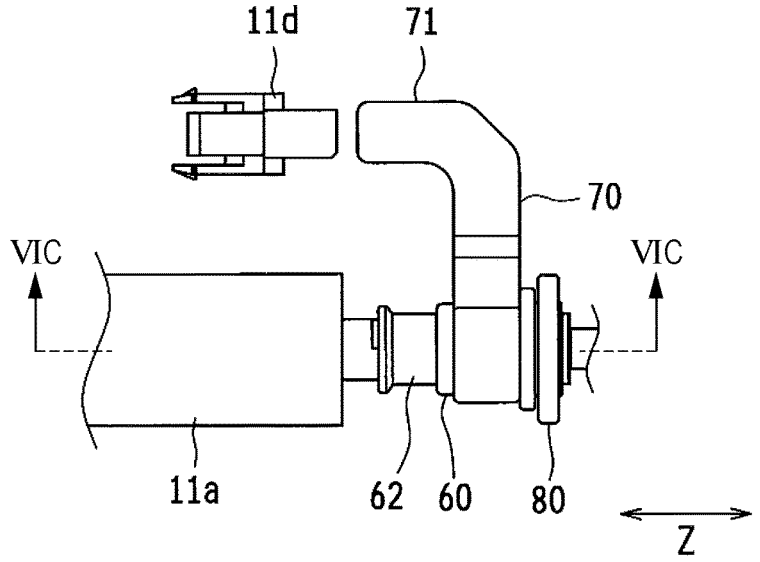
FIG. 6A is a schematic upper view illustrating the main components of a transfer device.
Figure 6B:
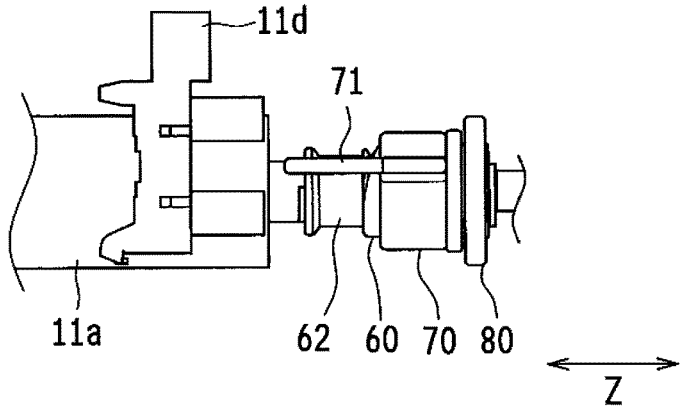
FIG. 6B is a schematic side view illustrating the main components of the transfer device.
Figure 6C:
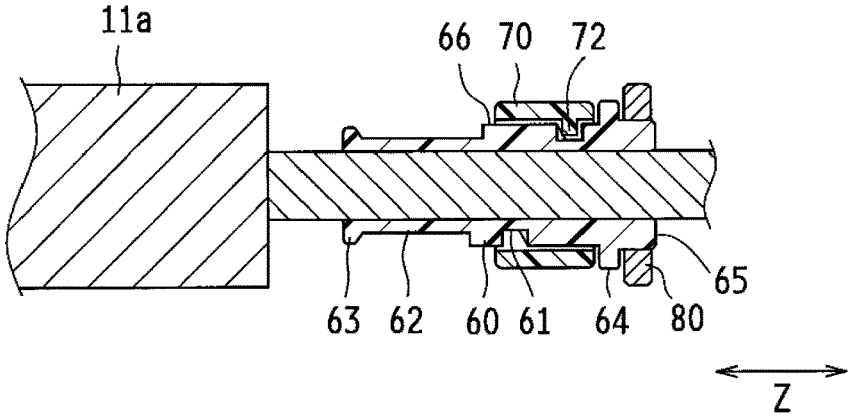
FIG. 6C is a schematic cross-sectional view taken along line VIC-VIC in FIG. 6A.

FIG. 6A is a schematic upper view illustrating the main components of the transfer device. FIG. 6B is a schematic side view illustrating the main components of the transfer device. FIG. 6C is a schematic cross-sectional view taken along line VIC-VIC in FIG. 6A.

In FIG. 6A to FIG. 6C, the movable member 70 and the collar 80 are fitted to the fixing member 60, and the fixing member 60 is fixed to the support 11*a*2. The guide protrusion 72 of the movable member 70 fits in the guide groove 61 of the fixing member 60 such that the movable member 70 is caught on the base 66 of the fixing member 60. In FIG. 6C, there is a space between the inner surface of the movable member 70 and the outer surface of the fixing member 60 for ease of understanding. However, the movable member 70 may be in contact with the fixing member 60 in a slidable manner. In this embodiment, the guide groove 61 and the guide protrusion 72 each have a substantially rectangular cross-sectional shape but may have any cross-sectional shape that allows the components to fit together, for example, a triangular cross-sectional shape. The detection object 71 is located at a position outside a detection area of the detector 11*d*(initial position) when the movable member 70 is caught on the base 66 of the fixing member 60. In such a state, the CPU (controller (not illustrated)) in the image forming apparatus 100 determines that the transfer roller 11*a* is a new one.

Figure 7A:
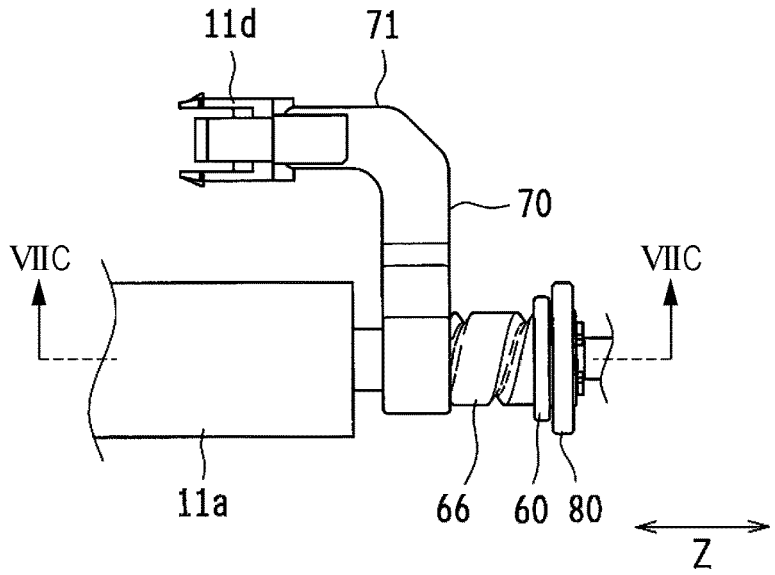
FIG. 7A is a schematic upper view illustrating the main components of the transfer device including a movable member that has been moved.
Figure 7B:
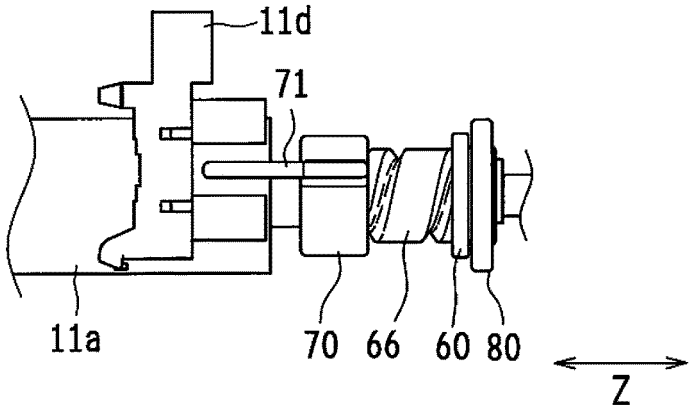
FIG. 7B is a schematic side view illustrating the main components of the transfer device including the movable member that has been moved.
Figure 7C:
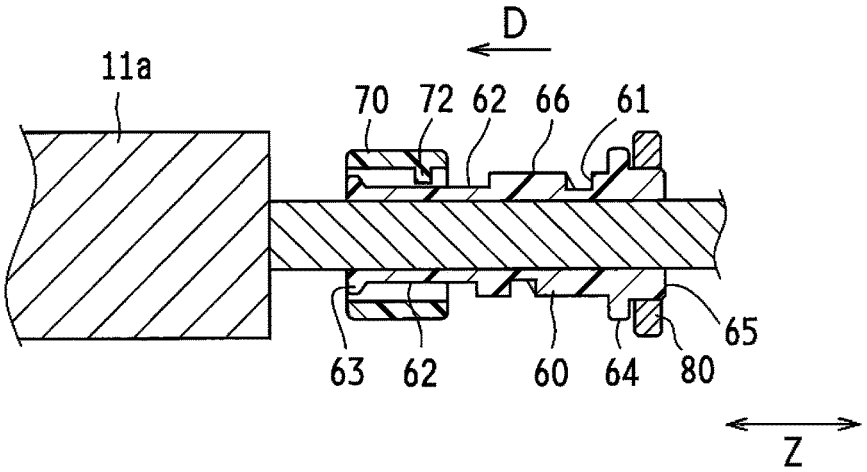
FIG. 7C is a schematic cross-sectional view taken along line VIIC-VIIC in FIG. 7A.

FIG. 7A is a schematic upper view illustrating the main components of the transfer device including the movable member that has been moved. FIG. 7B is a schematic side view illustrating the main components of the transfer device including the movable member that has been moved. FIG. 7C is a schematic cross-sectional view taken along line VIIC-VIIC in FIG. 7A.

In FIG. 6A to FIG. 6C, the roller holder 11*c* holding the transfer roller 11*a* has not been attached to the holder retainer 11*b*. The transfer roller 11*a* has not been rotated and is new. In FIG. 7A to FIG. 7C, the roller holder 11*c* has been attached to the holder retainer 11*b* and the transfer roller 11*a* has been rotated and is not new.

Specifically described, the fixing member 60 rotates with the transfer roller 11*a*. When the transfer roller 11*a* rotates, the movable member 70 does not rotate with the fixing member 60, because the movable member 70 is not fixed to the fixing member 60 and the detection object 71 is inserted in the slit 11*e*. Only the fixing member 60 rotates together with the transfer roller 11*a*.

At this time, the rotation of the fixing member 60 guides the guide protrusion 72 to the guide groove 61. The movable member 70 gradually moves from the side adjacent to the collar stopper 64 to the side adjacent to the retaining portion 62. In other words, the movable member 70 is moved in the axial direction Z (direction indicated by an arrow D in FIG. 7C) by using the guide protrusion 72. When the guide protrusion 72 moves beyond the boundary between the fix base 66 and the retaining portion 62, the movable member 70 is not caught on the fix base 66 and is retained by the retaining portion 62. At this time, the detection object 71 arrives at a detection position of the detector 11*d*.

As described above, the helical guide groove 61 and the slit 11*e*, which receives the detection object 71 of the movable member 70, allow the movable member 70 to move in the axial direction Z by using the guide protrusion 72 when the transfer roller 11*a* is rotated.

When the detector 11*d* detects the detection object 71, the controller determines that a new transfer roller 11*a* is used and initializes the operation condition of the transfer roller 11*a*. In other words, the controller initializes the operation condition of the transfer roller 11*a* when the transfer roller 11*a* is determined as a new one. This allows, when the used transfer roller 11*a* is replaced with a new one, the operation condition to be reliably initialized without any special operation. The proper operation condition is automatically set.

The movement of the movable member 70 retained by the retaining portion 62 is limited because the guide protrusion 72 is caught on the wide end 63. Furthermore, the movable member 70 retained by the retaining portion 62 is not able to return to the original position, and thus the detection state does not change. Specifically described, force that moves the movable member 70 is not applied to the movable member 70 because the guide protrusion 72 is not caught on the retaining portion 62 having the smaller diameter than the base 74 and the guide protrusion 72. Furthermore, the transfer roller 11*a* is rotated in one direction such that the guide protrusion 72 does not move along the guide groove 61 in the reverse direction.

Furthermore, the movable member 70 may have a guide protrusion 72 having a height smaller than the depth of the guide groove 61 and a base 74 having a width in the axial direction Z smaller than the width of the retaining portion 62 in the axial direction Z. In this configuration, the base 74 caught on the fix base 66 is lifted by the fix base 66 with a space between the tip of the guide protrusion 72 and the bottom of the guide groove 61. When the fixing member 60 is rotated until the base 74 is not caught on the fix base 66, the base 74 arrived at the retaining portion 62 is moved down to the retaining portion 62 by the height corresponding to the height lifted by the fix base 66. Thus, the ends of the base 74 in the axial direction Z are located between the wide end 63 and the fix base 66 (in an area of the retaining portion 62). In this configuration, since the base 74 is held between the side surface of the wide end 63 and the side surface of the fix base 66, the movable member 70 is not able to be moved. Thus, the detection state does not change.

As described above, in this embodiment, the fixing member 60 and the movable member 70 are connected to each other by the guide mechanism (for example, the guide groove 61 and the guide protrusion 72), which is configured to move the movable member 70 in the axial direction Z of the transfer roller 11*a*, and the movable member 70 is moved to the detection position of the detector 11*d* by the rotation of the transfer roller 11*a*. In other words, the movable member 70 configured to be moved by the rotation of the transfer roller 11*a* enables reliable detection by the detector 11*d*. Furthermore, the movable member 70 configured to move along the axis of the transfer roller 11*a* allows the movement mechanism of the movable member 70 and the detection mechanism to have a simple configuration and a smaller size.

In this embodiment, the fixing member 60 has the guide groove 61 and the movable member 70 has the guide protrusion 72, but the guide mechanism is not limited to this configuration. The guide groove 61 may be formed in one of the fixing member 60 and the movable member 70 and the guide protrusion 72 inserted in the guide groove 61 may be formed in the other. In other words, the fixing member 60 may have a guide protrusion and the movable member 70 may have a guide groove. As described above, the guide groove 61 and the guide protrusion 72 restricts the movement of the movable member 70 while allowing the movable member 70 to move in a predetermined direction.

As illustrated in FIG. 2, the roller holder 11*c* may have a structure allowing the axial end portion of the transfer roller 11*a* to be exposed when the transfer roller 11*a* is attached thereto. This configuration allows the user to readily see the movable member 70 and the fixing member 60, allowing recognition of the position of the movable member 70.

In this embodiment, the color image forming apparatus 100 including the intermediate transfer belt 7 is described. However, the technology herein is not limited to the color image forming apparatus and may be applied to a monochrome image forming apparatus including a photoreceptor and a transfer roller 11*a* that are in direct contact with each other.

Second Embodiment

Next, an image forming apparatus according to a second embodiment is described with reference to the drawings. The second embodiment has substantially the same structure as the first embodiment and identical reference numerals are used to denote identical or substantially identical components between the first and second embodiments. The identical components are not illustrated and not described.

Figure 8:
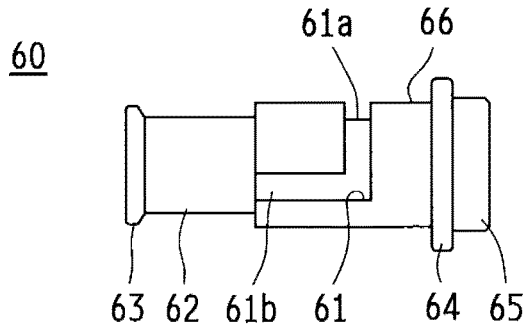
FIG. 8 is a schematic side view illustrating a fixing member in an image forming apparatus according to a second embodiment.

FIG. 8 is a schematic side view illustrating a fixing member of the image forming apparatus according to the second embodiment.

The second embodiment includes a fixing member 60 (a guide groove 61) having a different configuration from that in the first embodiment and further includes a biasing member 90 configured to bias the movable member 70. Specifically described, in the second embodiment, the guide groove 61 extending in the outer surface of the fixing member 60 includes a locking portion 61*a* extending in the circumferential direction of the transfer roller 11*a* and a guide portion 61*b* extending in the axial direction Z of the transfer roller 11*a*. The locking portion 61*a* in the fix base 66 is located adjacent to the collar stopper 64. The guide portion 61*b* extends continuously from one end of the locking portion 61*a* toward the retaining portion 62.

Next, a new transfer roller 11*a* and an in-use transfer roller 11*a* of the second embodiment are described with reference to the drawings. FIG. 9A to FIG. 10B are schematic views illustrating only some of the components of the image forming apparatus 100 for ease of understanding.

Figure 9A:
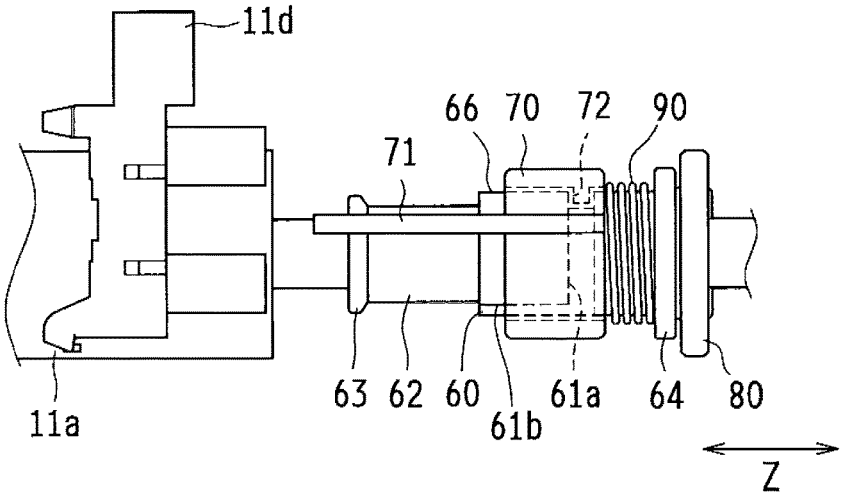
FIG. 9A is a schematic side view illustrating the main components of the transfer device.
Figure 9B:
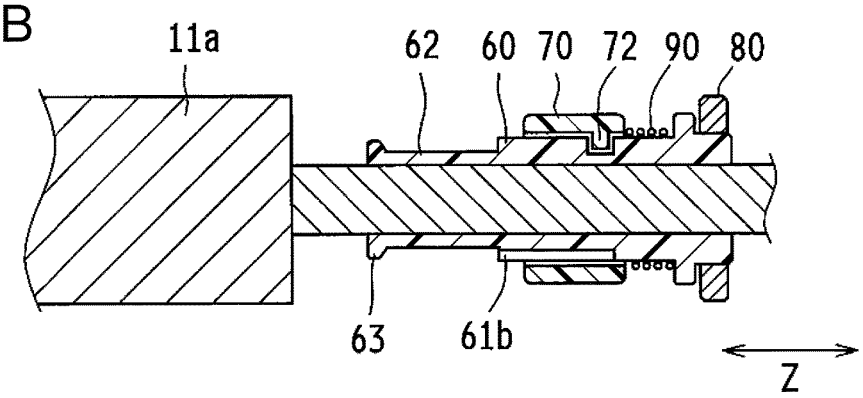
FIG. 9B is a schematic side view illustrating the main components of the transfer device.

FIG. 9A is a schematic side view illustrating the main components of the transfer device. FIG. 9B is a schematic cross-sectional view illustrating the main components of the transfer device.

The movable member 70 caught on the fixing member 60 has the guide protrusion 72 inserted in the locking portion 61*a* of the guide groove 61. The guide protrusion 72 is located adjacent to an end of the locking portion 61*a* away from the guide portion 61*b*.

The biasing member 90 is a coil spring wound around the fixing member 60 and is located between the collar stopper 64 and the movable member 70 to bias the movable member 70 toward the retaining portion 62. Since the guide protrusion 72 of the movable member 70 is inserted in the locking portion 61*a*, the movable member 70 does not move in the axial direction Z when biased by the biasing member 90. In the second embodiment, the movable member 70 is located at the initial position when caught on the fix base 66 of the fixing member 60 as in the first embodiment.

Figure 10A:
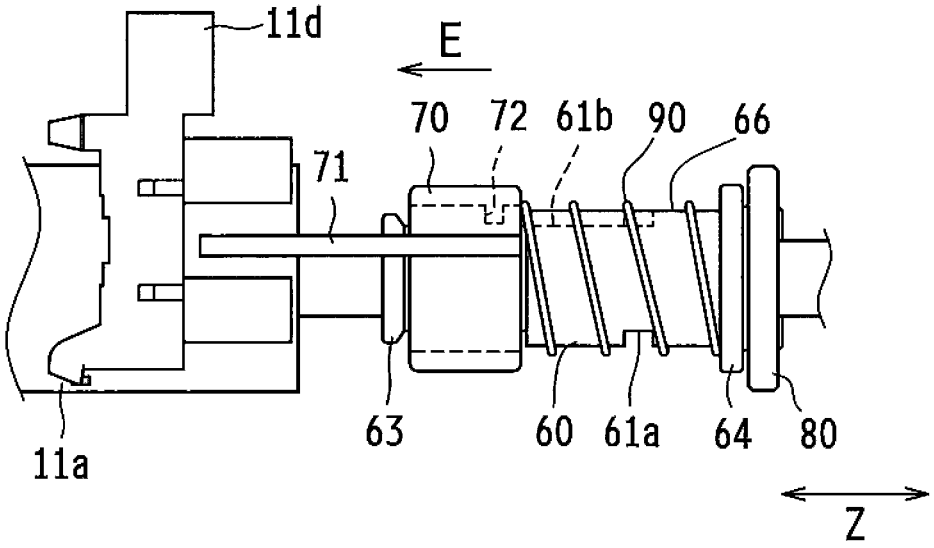
FIG. 10A is a schematic side view illustrating the main components of the transfer device including a movable member that has been moved.
Figure 10B:
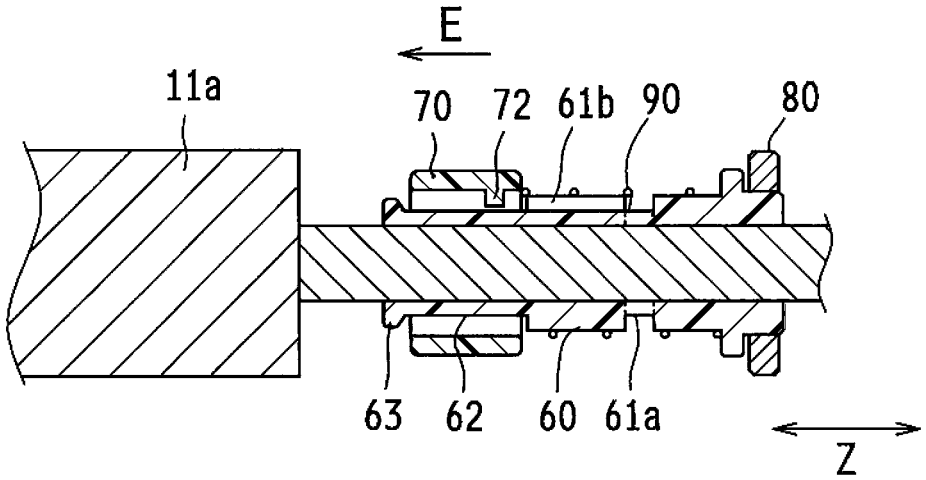
FIG. 10B is a schematic cross-sectional view illustrating the main components of the transfer device including the movable member that has been moved.

FIG. 10A is a schematic side view illustrating the main components of the transfer device including the movable member that has been moved. FIG. 10B is a schematic cross-sectional view illustrating the main components of the transfer device including the movable member that has been moved.

Contrary to FIG. 9A and FIG. 9B, FIG. 10A and FIG. 10B illustrate the state after rotation of the transfer roller 11*a*. In the second embodiment, the fixing member 60 rotates with the transfer roller 11*a* but the movable member 70 does not rotate as in the first embodiment. Then, the guide protrusion 72 caught in the locking portion 61*a* is moved to the end adjoining the guide portion 61*b* where the movable member 70 is not caught in the locking portion 61*a*. Then, the movable member 70 is biased by the biasing member 90 and moved in the axial direction Z (direction indicated by an arrow E). The movable member 70 moved in the axial direction Z is retained by the retaining portion 62 and arrives at the detection position. In other words, the combination of the guide groove 61 having the above-described shape and the biasing member 90 provides both the locking structure and the guiding structure for the movable member 70.

Third Embodiment

Next, an image forming apparatus according to a third embodiment is described. The third embodiment has substantially the same structure as the first and second embodiments and the identical components are not illustrated and not described.

In the third embodiment, the movable member 70 and the fixing member 60 have different colors. In this embodiment, the fixing member 60 is white and the movable member 70 is black. The movable member 70 and the fixing member 60 having different colors allow the user to readily recognize if the movable member 70 is moved relative to the fixing member 60. Furthermore, when the detector 11*d* is an optical sensor, the black detection object 71 having higher light-blocking properties reduces false detection by reflected light.

The present disclosure contains subject matter related to that disclosed in Japanese Priority Patent Application JP 2017-238019 filed in the Japan Patent Office on Dec. 12, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A replaceable unit detachably attachable to an apparatus body comprising:

a rotating body configured to rotate about an axis thereof when the replaceable unit is attached to the apparatus body;

a fixing member fixed to an axial end portion of the rotating body;

a movable member caught on the fixing member; and a detector configured to indicate different detection states depending on a position of the movable member, wherein the fixing member and the movable member are connected to each other through a guide mechanism configured to move the movable member in an axial direction of the rotating body, the movable member is moved to a detection position of the detector by rotation of the rotating body.

2. The replaceable unit according to claim 1, wherein one of the fixing member and the movable member has a guide groove and the other has a guide protrusion inserted in the guide groove, the guide groove and the guide protrusion forming the guide mechanism.

3. The replaceable unit according to claim 2, wherein the guide groove extends helically about an axis of the rotating body in an outer surface of the fixing member.

4. The replaceable unit according to claim 2, further comprising a biasing portion configured to bias the movable member in the axial direction of the rotating body, wherein the guide groove includes a locking portion extending in a circumferential direction of the rotating body and a guide portion extending in the axial direction of the rotating body.

5. The replaceable unit according to claim 1, wherein the fixing member includes a retaining portion having a smaller outer diameter than a portion including the guide mechanism, the movable member is retained by the retaining portion when moved to the detection position.

6. The replaceable unit according to claim 1, wherein the movable member and the fixing member have different colors.

7. An image forming apparatus comprising:

the replaceable unit according to claim 1; and a controller configured to determine whether the replaceable unit is a new one based on a detection result of the detector, wherein the controller is configured to initialize an operation condition of the replaceable unit when the replaceable unit is determined as a new one.

* * * * *